United States Patent [19]

Puccio

[11] Patent Number: 4,746,129

[45] Date of Patent: May 24, 1988

[54] EXPANSION JOINT STRIP SEAL

[76] Inventor: Guy S. Puccio, 28 Sargent Dr., Amherst, N.Y. 14226

[21] Appl. No.: 96,915

[22] Filed: Sep. 14, 1987

[51] Int. Cl.[4] ..... F16J 15/10; E01C 11/10

[52] U.S. Cl. ..... 277/205; 277/207 R; 404/65

[58] Field of Search ..... 277/205, 207, 237 R, 277/192; 404/64–66

[56] References Cited

U.S. PATENT DOCUMENTS

| | | | |
|---|---|---|---|
| 3,888,599 | 6/1975 | Reifsnyder | 404/69 |
| 3,994,609 | 11/1976 | Puccio | 404/69 |
| 4,067,660 | 1/1978 | Puccio | 404/65 |
| 4,366,590 | 1/1983 | Huber et al. | 404/64 X |
| 4,367,976 | 1/1983 | Bowman | 404/64 X |
| 4,447,172 | 5/1984 | Galbreath | 404/65 X |
| 4,488,324 | 12/1984 | Hartkorn | 404/65 X |

FOREIGN PATENT DOCUMENTS

| | | |
|---|---|---|
| 586790 | 6/1975 | Switzerland . |
| 2109837 | 6/1983 | United Kingdom . |

OTHER PUBLICATIONS

Structural Accessories, Model Nos. 40–SF and 40–SD (date between 1979 and 1981).

*Primary Examiner*—Robert S. Ward

*Attorney, Agent, or Firm*—Bean, Kauffman & Bean

[57] ABSTRACT

An expansion joint strip seal for use in roadways, bridges, buildings and the like to seal across a gap defined by a pair of parallel, elongated edge or frame members, which have generally C-shaped cavities opening towards the gap for purposes of supporting opposite lengthwise extending edges of the strip seal. The strip seal is formed of a suitable resiliently deformable material and defined by a web portion sized to span the gap and a pair of mounting bead portions joined to opposite edges of the web portion and adapted for insertion within the cavities of the edge members. Each mounting bead portion includes a solid or non-apertured main mounting portion, which is joined to the web portion and provided with a height essentially corresponding to the height of the cavity and a width less than the width of the cavity; and a tongue portion cantilever supported by the main mounting portion to project in a direction away from the web portion. The tongue portion is resiliently deformed, as an incident to insertion of the mounting bead portion into its cavity for purposes of establishing a bias or lever action on the main mounting portion tending to prevent subsequent disassembly of the seal.

7 Claims, 1 Drawing Sheet

Fig. 1.
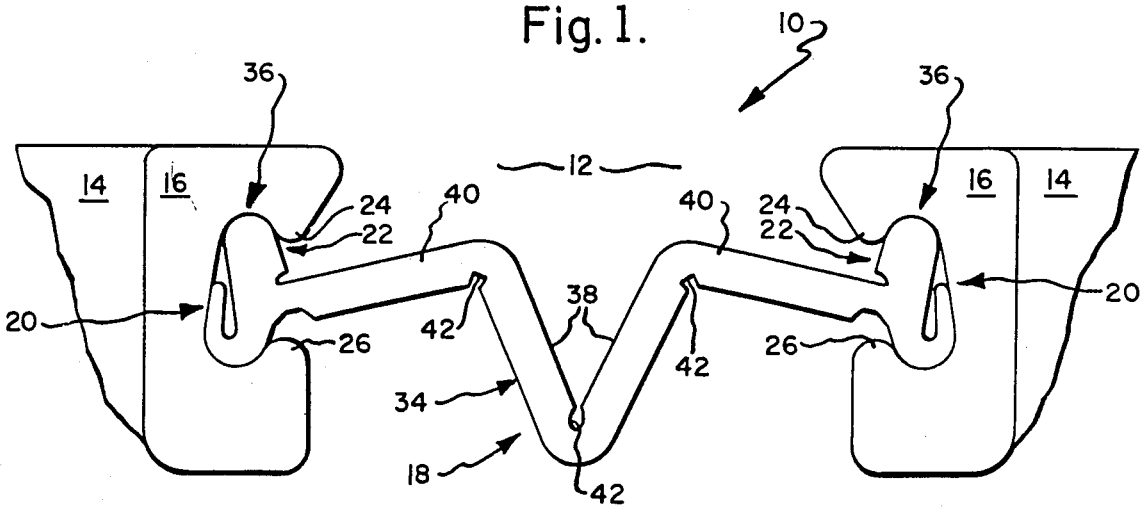
Fig. 2.
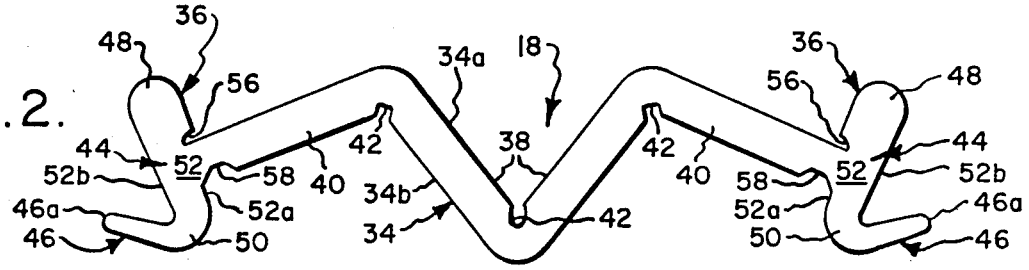
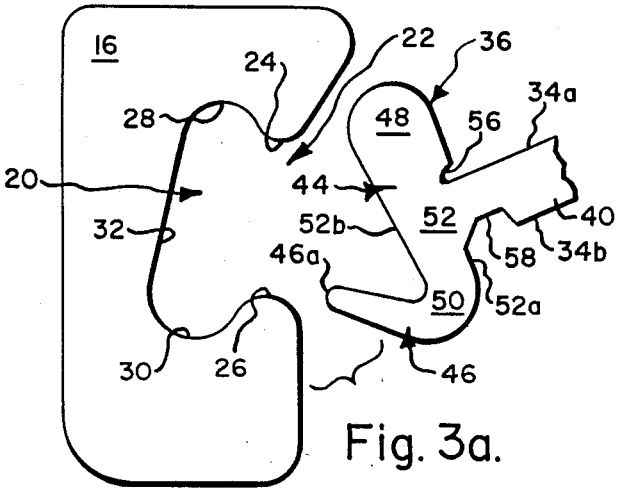
Fig. 3a.
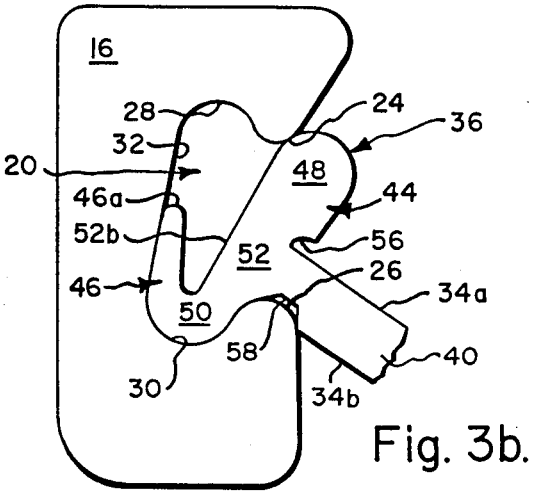
Fig. 3b.
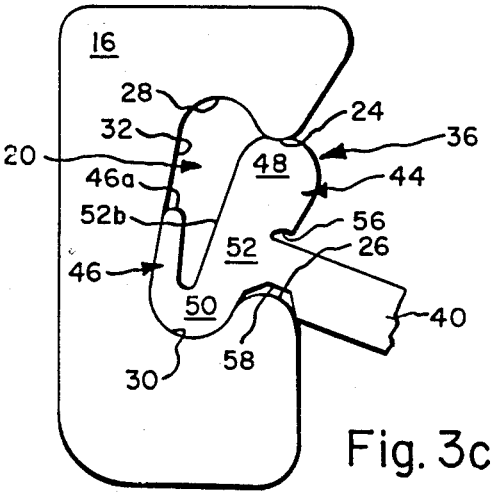
Fig. 3c.
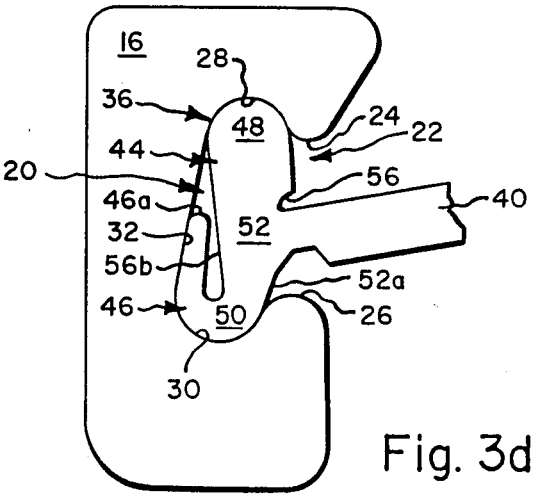
Fig. 3d.

EXPANSION JOINT STRIP SEAL

BACKGROUND OF THE INVENTION

The present invention relates to expansion joint seals of the type used for sealing an expansion joint gap against the intrusion of dirt, water or the like. This type of expansion joint conventionally comprises an elongated resiliently deformable strip seal in combination with a pair of rigid edge members which are installed on opposite sides of the gap and formed with cavities opening towards the gap for purposes of supporting opposite lengthwise extending edges of the strip seal.

A problem encountered with many available expansion joint seals is that during use their mounting bead portions become dislodged from one or the other of the edge members over part or all of the length of the seal with the result that the seal no longer functions for its intended purpose. Much of the problem stems from the fact that commercially available edge members are extruded through dies, which experience a substantial degree of wear during the extrusion process. As by way of example, extruded edge members on the order of 20 feet in length, such as might be utilized in a bridge joint, experience a progressive reduction in the size of its cavity, such that a given internal dimension of the cavity may vary upwards of almost ¼ inch between opposite ends of the edge member. Further, while relatively uniformly sized extruded joint seals may be fabricated, it is nonetheless not unusual to find intermittent variations in dimension of the strip seal. As a result of these manufacturing variations, it has been common practice to size the mounting bead portion of the strip seal to the mean expected size of the cavities with the result that at one end of each edge member the mounting bead portion is loosely retained and prone to dislodgement from its receiving cavity, whereas at the other end of the edge member it is a difficult and time consuming operation to force the mounting bead portion into such cavity.

Further, in expansion joints of the type under consideration, it is inconvenient or impossible to insert the mounting bead portions of strip seals lengthwise within their associated cavities. Thus, the mounting bead portions must be designed so as to allow their size to be reduced sufficiently to permit insertion into the cavity through its opening, which faces the gap. A most common technique, as shown by way of example in U.S. Pat. Nos. 3,994,609 and 4,067,660, involves making the mounting bead portion of a hollow, relatively thin walled construction so as to permit compression thereof incident to insertion within the cavity. Unfortunately, the typical hollow mounting bead construction is such as to allow tension forces applied to the web to subsequently compress the hollow mounting bead sufficiently to permit dislodgement thereof from the cavity. These patents seek to remedy this problem by providing an outer surface of the mounting bead portion with a radius of curvature in its unstressed state, which is less than the radius of curvature of the rear wall of the cavity, such that the tendency of the outer surface of the mounting bead to assume the radius of curvature of such rear wall, as an incident to insertion, biases upper and lower surfaces of such mounting bead to expand into locking engagement with opposed surfaces of the cavity. A problem encountered with this type of construction, particularly adjacent the end of an edge member at which its cavity is smallest in size, is the difficulty of effecting insertion of the mounting bead portion in view of the tendency of the upper and lower portions of the mounting bead portion to move apart incident to deformation of the outer surface of the mounting bead portion to conform with the curvature of the rear surface of the cavity.

An alternate approach is suggested by U.S. Pat. No. 3,888,599 wherein the mounting bead portion of the strip seal has its outward surface shaped to essentially correspond in configuration to the inner surface of the cavity and is provided with a large concavity on its inner surface facing towards the gap, which serves to divide the mounting bead portion centrally thereof into upper and lower parts bendable relative to one another. A drawback of this construction is that it appears to require that a workman have access to the interior of an expansion joint, i.e. below the level of the strip seal, for seal installation purposes, and this is either inconvenient or not possible in most expansion joint installations of the type wherein joint seals of this nature would be expected to be employed. Moreover, the size and positioning of the concavity is such as to "weaken" the mounting head portion and facilitate its dislodgement from within the cavity of the edge member upon the application of downwardly directed tension forces to the web portion of the strip seal.

SUMMARY OF THE INVENTION

In accordance with the present invention there is provided a strip seal employing an improved mounting bead portion, which is both relatively easy to install within a variably sized cavity of an edge member, while at the same time operable to effectively prevent disassembly thereof relative to the edge member, as a result of tension forces applied to the web portion of such strip seal.

More specifically, in accordance with the present invention, each mounting bead portion of a strip seal is formed with a main mounting portion having one of its sides connected to the web portion and a tongue portion cantilever supported on an opposite side of the main mounting portion to project in a direction away from the web portion. Preferably, the tongues are joined to the main mounting portions such that the mounting bead portions are of mirror image generally J-shaped and L-shaped cross-sectional configurations.

The length or vertical height of the main mounting portion, as measured transversely of the web portion, preferably corresponds essentially to the average vertical height of the cavity of the edge member, whereas its width or transverse dimension is chosen such that its opposite side is spaced from the rear wall of the cavity, upon assembly of the mounting bead portion within the cavity, through a distance equal to and preferably greater than the width or transverse dimension of the tongue portion. The length of the tongue portion is preferably sufficient to insure that the tongue portion and the main mounting portion cooperate to substantially fill the cavity after assembly of the mounting bead portion is completed without resulting in deformation of the main mounting portion as a result of surface to surface engagement with the tongue portion.

A relatively shallow first groove is preferably formed in the one side of the main mounting portion at a point immediately above its juncture with the web portion to facilitate bending deformation of an upper end of the main mounting portion relative to a lower end thereof to which the tongue portion is attached. This groove also serves to create a discontinuity, which partially isolates the upper end from tension forces or loads applied to the web portion during use of the expansion joint, thereby enabling the mounting bead portion to more effectively resist unintended disassembly thereof from within the cavity. A second groove may be provided in the lower surface of the web portion immediately adjacent the one side of the main mounting portion, as required to provide sufficient clearance between the web portion and an edge member as will enable initial insertion of the main mounting portion into the cavity without effecting deformation of the main mounting portion or the web portion.

Assembly of the mounting bead portion within the cavity is effected by first inserting the tongue portion and the lower end of the main mounting portion through a seal assembly opening of the edge member into the cavity, so as to progressively deform the tongue portion and thus create a resilient bias, which will thereafter aid in retaining the mounting bead portion in assembled condition within the cavity. Thereafter, force is applied to the main mounting portion sufficiently to push same into assembled condition within the cavity. As this force is applied, the upper end is first caused to bend in the area of the first groove in a direction extending downwardly relatively towards the web portion and then to compress in a direction extending lengthwise of the main mounting member sufficiently to permit the whole of the main mounting portion to enter the opening in the edge member leading to the cavity. As the upper end enters into the cavity, it resiliently returns to its as-formed configuration and thereafter locks the mounting bead portion in assembled condition.

BRIEF DESCRIPTION OF THE DRAWINGS

The nature and mode of operation of the present invention will now be more fully described in the following detailed description taken with the accompanying drawings wherein:

FIG. 1 is a vertical sectional view of an expansion joint incorporating the strip seal of the present invention;

FIG. 2 is a vertical sectional view of the strip seal shown in FIG. 1, but in an unstressed condition; and FIGS. *3a–3d* are sectional views showing stages of the expansion joint assembly operation.

DETAILED DESCRIPTION

Reference is first made to FIG. 1, wherein an expansion joint formed in accordance with the present invention is generally designated as 10 and shown as being adapted to bridge a gap 12 between a pair of structural members 14 and 14, such as may be defined by concrete slabs forming a bridge or road surface. Expansion joint 10 may include a pair of elongated edge members 16 and 16, which are embedded or otherwise permanently affixed to slabs 14 and 14; and a resiliently deformable strip seal 18 intended to be supported by the edge members for purposes of sealing across gap 12.

As best shown in the case of left hand edge member 16 viewed in FIGS. *3a–3d*, each of the edge members includes a cavity 20 of generally C-shaped cross-section communicating with a seal assembly or insertion opening 22, which is arranged to face towards gap 12 and extend lengthwise of the edge members between opposed projecting portions 24 and 26. Cavity 20 may be considered as being bounded by a pair of retaining recesses in the form of upper and lower recesses 28 and 30, which are arranged adjacent projecting portions 24 and 26, respectively, and on opposite sides of opening 22, and a rear wall 32 serving to interconnect recesses 28 and 30 and arranged to face towards opening 22. Spacing between recesses 28 and 30 may be considered as defining the height of cavity 20, whereas the spacing between rear wall 32 and the inner surfaces of projecting portions 24 and 26 may be considered as defining the depth of the cavity.

Sealing strip 18 is shown in FIGS. 1 and 2 as generally comprising a web portion 34 sized to bridge between edge members 16 and 16 and a pair of mounting bead portions 36 and 36 joined to the opposite edges of the web portion. Web portion 34 may be variously constructed, but preferably, as shown in the drawings, is formed with a V-shaped central section defined by like panels 38 and 38, and outer sections defined by downwardly and outwardly diverging panels 40 and 40. Preferably, stress relief recesses 42 are provided adjacent the juncture of the panels 38, 38, 40 and 40 to facilitate folding of web 18 incident to contraction of expansion joint 10.

Mounting bead portions 36 and 36 each include a main mounting or main leg portion 44 and a tongue or minor leg portion 46, which in accordance with the preferred form of the invention are arranged to provide the mounting bead portions with mirror image, generally J-shaped and L-shaped cross sectional configurations. Main mounting portion 44 is formed with opposed mounting or upper and lower end portions 48 and 50 whose opposed surfaces are preferably sized and shaped to generally conform to retaining recesses 28 and 30, respectively, and a central portion 52 interconnecting the opposed mounting portions. Central or interconnecting portion 52 may be considered as having a first side or surface **52*a*, which is joined to one edge of web portion 34, such as panel 40, and a second or oppositely facing side or surface 52*b*, which is intended to be arranged in a facing relationship to cavity rear wall 32 upon assembly of mounting bead portion 36 within cavity 20. Preferably, a first groove 56 is formed in first side 52*a* adjacent the juncture thereof with a first or upper surface 34*a* of web portion 34, and a second groove 58 is formed in a second or lower surface 34*b*** of such web portion adjacent the juncture thereof with the first side.

The as-formed or unstressed height or lengthwise dimension of main mounting portion 44, as measured between the opposed surfaces of end portions 48 and 50, preferably corresponds to the mean or average height dimension of cavity 20, whereas the width or transverse dimension of the main mounting portion, as measured centrally thereof between first and second sides **52*a* and 52*b*, is substantially less than the width of the cavity, such that the second side is spaced from cavity rear wall 32 sufficiently to accommodate tongue portion 46 therebetween, when mounting bead portion 36 is fully assembled within cavity 20 as shown in FIGS. 1** and *3d*. Preferably, mounting bead portion 36 is sized such that when in assembled condition, the facing surfaces of tongue portion 46 and second side **52*b*** are spaced slightly apart as shown in FIG. *3d*, so as not to interfere with the insertion of the mounting bead portion into cavity 20 in the manner to be described. It is contemplated that due to irregularities in the size of cavity 20, there may be instances where the facing surfaces of the tongue and main mounting portions will engage at least adjacent the free end 46a of the tongue portion, but it is important to insure that no substantial compressive resilient deformation of these portions occurs, since otherwise the tongue portion will interfere with or prevent assembly of the mounting bead portion within the cavity. The shape and/or placement of second side 52b will depend upon the point of attachment of tongue portion 46 to main mounting portion 44, as well as the length of the tongue portion, as measured between its free end 46a and such point of attachment, and the width or transverse dimension of the tongue portion.

Tongue portions 46 are shown in FIGS. 2 and 3a as being arranged relative to their respective main mounting portions 44 to form an angle of less than about 90° and preferably on the order of about 45° to 55°, in order to permit engagement of free end 46a with cavity rear wall 32 in a manner which will automatically serve to cam the tongue portion relatively towards second side 52b, as an incident to insertion of mounting bead portion 36 into cavities 20. The length of each tongue portion 46 is chosen such that it is less than the height of its cavity 20, so as not to interfere with insertion and proper seating of its associated upper end portion 48, but greater than the difference between the depth of such cavity and the width of its associated main mounting portion 46 in order to insure that such tongue portion is forced to undergo resilient bending deformation to lie closely adjacent to such main mounting portion, as an incident to the assembly operation.

By now referring to FIGS. 3a and 3b, it will be understood that assembly of mounting bead portion 36 within cavity 20 is effected by first positioning the unstressed or as-formed mounting bead portion adjacent cavity opening 22 and then inserting tongue portion 46 and lower end portion 50 into the cavity until these portions are seated in engagement with cavity rear wall 32 and lower retaining recess 30, respectively, and upper end portion 48 is disposed in abutting engagement with upper opposed projecting portion 24, as shown in FIG. 3b. Incident to this step of the assembly operation, free end 46a of tongue portion 46 is brought initially into engagement with cavity rear wall 32, whereby the tongue portion is bent relatively adjacent its point of attachment to lower end portion 50 and caused to move or pivot towards connecting portion 52. The provision of second recess 58 on the lower surface of web portion 34 prevents or minimizes engagement of the web portion with lower opposed projecting portion 26, which would otherwise interfere with insertion and seating of lower end portion 50, as best shown in FIG. 3b.

Assembly of mounting bead portion 36 is completed by applying pressure to first side 52a adjacent upper end portion 48 to force the latter to move between the partially assembled and fully assembled positions thereof shown in FIGS. 3b and 3d, respectively, through an intermediate or over-center position shown in FIG. 3c. It will be understood that, as the upper end portion 48 is forced to move from the position shown in FIG. 3b into the position shown in FIG. 3c, surface to surface engagement of the upper end portion with upper opposed projecting portion 24 causes the upper end portion to deform relative to the remaining portions of main mounting portion 44 first by being bent relatively towards web portion upper surface 34a in the region defined by first recess 56 and then by being axially compressed. As upper end portion 48 is forced to move beyond the over-center position shown in FIG. 3c, it is permitted to resiliently expand until it is fully seated within upper retaining recess 28, as shown in FIG. 3d, whereupon it assumes or essentially assumes its as-formed configuration and the assembly operation is completed.

As is conventional practice, a suitable lubricant-/adhesive composition may be applied to the surfaces of the mounting bead portions prior to the assembly operation in order to reduce frictional forces tending to oppose insertion of the mounting bead portions into the cavities of the edge members and to thereafter assist in the creation of a fluid seal therebetween. Also, in accordance with prior commercial practice, a suitable manually operable tool, not shown, may be employed to assist in the forcing of the mounting bead portions into the cavities.

What is claimed is:

1. An expansion joint strip seal for bridging a gap between a pair of elongated members each having a cavity of generally C-shaped cross section for mounting said seal, each said cavity having a seal assembly opening facing towards said gap and extending lengthwise of its one of said members between opposed projecting portions defined by its one of said members, each said cavity being bounded by a pair of retaining recesses arranged adjacent said projecting portions on opposite sides of said opening and a rear wall interconnecting said retaining recesses and facing towards said opening, the spacing between said retaining recesses defining the height of said cavity and the spacing between said rear wall and said projecting portions defining the depth of said cavity, said seal comprising:

an elongated resiliently deformable strip having a web portion sized to bridge said gap and a pair of mounting bead portions joined to opposite edges of said web portion and adapted for insertion one within each said cavity through said opening thereof for mounting said strip on said members, each of said mounting bead portions having a main mounting portion and a tongue portion, said main mounting portion having in cross section opposed mounting portions generally conforming to the shape of said retaining recesses and an interconnecting portion having a first side joined to one of said edges of said web portion and a second oppositely facing side, said opposed mounting portions are spaced apart through a distance essentially corresponding to said height of said cavity, said first and second sides of said connecting portion are spaced apart through a distance less than said depth of said cavity, said tongue portion is cantilever supported by said main mounting portion and projects transversely away therefrom in a direction away from said web, said tongue portion has a length as measured between a free end surface thereof and said second side less than said height of said cavity, but greater than the difference between said depth of said cavity and the distance between said first and second sides of said connecting portion, and said tongue has a transverse dimension essentially equal to said difference.

2. An expansion joint strip seal for bridging a gap between a pair of elongated members each having a cavity of generally C-shaped cross section for mounting said seal, each said cavity having a seal assembly opening facing towards said gap and extending lengthwise of its one of said members between opposed projecting portions defined by its one of said members, each said cavity being bounded by a pair of retaining recesses arranged adjacent said projecting portions on opposite sides of said opening and a rear wall interconnecting said retaining recesses and facing towards said opening, the spacing between said retaining recesses defining the height of said cavity and the spacing between said rear wall and said projecting portions defining the depth of said cavity, said seal comprising:

an elongated resiliently deformable strip having a web portion sized to bridge said gap and a pair of mounting bead portions joined to opposite edges of said web portion and adapted for insertion one within each said cavity through said opening thereof for mounting said strip on said members, each of said mounting bead portions has a main mounting portion and a tongue, said main mounting portion has a height corresponding essentially to said height of said cavity and a width less than said depth of said cavity, said main mounting portion has one side thereof connected to one of said edges of said web and arranged to engage with said projecting portions when said main mounting portion is inserted within said cavity, said tongue is cantilever supported on said main mounting portion and has a free end spaced therefrom in a direction away from said web, said free end when its one of said mounting bead portions is in an unstressed and uninserted condition being spaced from said one side through a distance greater than said depth of said cavity so that upon insertion of its one of said mounting bead portions within said cavity to position said one side in engagement with said projecting portions and said free end in engagement with said rear wall, said tongue is resiliently deformed and serves to retain its one of said main mounting portions within said cavity.

3. An expansion joint strip seal for bridging a gap between a pair of elongated members each having a cavity of generally C-shaped cross section for mounting said seal, each said cavity having a seal assembly opening facing towards said gap and extending lengthwise of its one of said members between opposed projecting portions defined by its one of said members, each said cavity being bounded by a pair of retaining recesses arranged adjacent said projecting portions on opposite sides of said opening and a rear wall interconnecting said retaining recesses and facing towards said opening, the spacing between said retaining recesses defining the height of said cavity and the spacing between said rear wall and said projecting portions defining the depth of said cavity, said seal comprising:

an elongated resiliently deformable strip having a web portion sized to bridge said gap and a pair of mounting bead portions joined to opposite edges of said web portion and intended to be inserted one within each said cavity through said opening thereof for mounting said strip on said members, each of said mounting bead portions having a main leg portion and a minor leg portion, said main leg portion having a length as measured between opposite ends thereof corresponding essentially to said height of said cavity and a width as measured between first and second sides thereof less than said depth of said cavity, said web is joined to said first side of said main leg portion intermediate said opposite ends thereof, said minor leg portion is joined to said main leg portion adjacent one of said opposite ends thereof and has a free end spaced from said second side in a direction away from said web, and the distance between said free end and said first side exceeds said depth of said cavity.

4. A strip seal according to claim 3, wherein said web portion has first and second surfaces, said second surface facing generally towards said one of said opposite ends of said main leg portion to which said minor leg portion is joined, a first groove is formed in said first side of said main leg portion adjacent said first side surface of said web, and a second groove is formed in said second surface of said web adjacent said first side of said main leg portion.

5. An expansion joint for bridging across and sealing a gap between a pair of structural members, said joint comprising in combination:

a pair of elongated members adapted for connection one to each of said structural members to extend lengthwise and adjacent opposite edges of said gap, said elongated members each having a cavity of generally C-shaped cross section, each said cavity having an assembly opening facing inwardly of said gap and extending lengthwise of its one of said elongated members between opposed projecting portions defined by its one of said elongated members, each said cavity being bounded by a pair of retaining recesses arranged adjacent said projecting portions on opposite sides of said assembly opening and a rear wall interconnecting said retaining recesses and facing towards said assembly opening, the spacing between said retaining recesses defining the height of said cavity and the spacing between said rear wall and said projecting portions defining the depth of said cavity; and an elongated, resiliently deformable strip seal for bridging across and sealing between said elongated members, said seal having a web portion sized to bridge between said elongated members and having lengthwise extending opposite edges thereof received one within each of said assembly openings, and a pair of mounting bead portions joined one to each of said opposite edges of said web portion and received one within each said cavity for mounting said seal on said elongated members, each of said mounting bead portions having a main leg portion and a minor leg portion, said main leg portion having a length as measured between opposite ends thereof corresponding essentially to said height of said cavity and a width as measured between first and second sides thereof less than said depth of said cavity, said web is joined to said first side of said main leg portion intermediate said opposite ends thereof, said minor leg portion is cantilever supported by said main leg portion to project from said second side thereof, said minor leg portion having a free end disposed intermediate said second side and said rear wall and intermediate said opposite ends of said main leg portion, and said minor leg portion is in a resiliently deformed condition and tends to bias said opposite ends of said main leg portion into engagement with said opposed projecting portions.

6. An expansion joint according to claim 5, wherein said minor leg portion is joined to said main leg portion adjacent one of said opposite ends thereof, said web portion has first and second surfaces, said second surface facing generally towards said one of said opposite ends of said main leg portion, a first groove is formed in said first side of said main leg portion adjacent said first side surface of said web.

7. An expansion joint according to claim 6, wherein a second groove is formed in said second surface of said web adjacent said first side of said main leg portion, and said second groove is sized to receive without substantial deformation of said seal that one of said opposed projecting portions arranged for engagement by said one of said opposite ends of said main leg portion.

* * * * *